US007594599B2

(12) United States Patent
Webb

(10) Patent No.: US 7,594,599 B2
(45) Date of Patent: Sep. 29, 2009

(54) HAND-HELD POWER TOOL

(75) Inventor: Roger Clyde Webb, George Town (AU)

(73) Assignees: Poly Systems Pty Ltd (AU); Max Co Ltd (JP)

( * ) Notice: Subject to any disclaimer, the term of this patent is extended or adjusted under 35 U.S.C. 154(b) by 0 days.

(21) Appl. No.: 11/994,172

(22) PCT Filed: Jun. 29, 2006

(86) PCT No.: PCT/AU2006/000920

§ 371 (c)(1),
(2), (4) Date: Feb. 14, 2008

(87) PCT Pub. No.: WO2007/000031

PCT Pub. Date: Jan. 4, 2007

(65) Prior Publication Data

US 2008/0203133 A1 Aug. 28, 2008

(30) Foreign Application Priority Data

Jun. 29, 2005 (AU) ..... 2005903436

(51) Int. Cl.
*B25C 1/06* (2006.01)

(52) U.S. Cl. ..... 227/10; 227/130; 123/46 SC

(58) Field of Classification Search ..... 227/10, 227/8, 9, 130; 123/46 SC
See application file for complete search history.

(56) References Cited

U.S. PATENT DOCUMENTS 3,042,008 A * 7/1962 Liesse ..... 123/46 SC
3,850,359 A * 11/1974 Obergfell ..... 227/10
3,967,771 A * 7/1976 Smith ..... 227/10
4,075,850 A * 2/1978 Nakazato et al. ..... 60/633
4,377,991 A * 3/1983 Liesse ..... 123/46 SC
4,403,722 A * 9/1983 Nikolich ..... 227/8
4,483,473 A * 11/1984 Wagdy ..... 227/8
4,522,162 A * 6/1985 Nikolich ..... 123/46 SC
4,665,868 A * 5/1987 Adams ..... 123/46 SC
4,721,240 A * 1/1988 Cotta ..... 227/10
4,773,581 A * 9/1988 Ohtsu et al. ..... 227/10

(Continued)

FOREIGN PATENT DOCUMENTS

DE 4243618 A 6/1994

(Continued)

*Primary Examiner*—Scott A. Smith
(74) *Attorney, Agent, or Firm*—Daniel B. Schein, Esq.

(57) ABSTRACT

A hand-held power tool is provided, the operational power of which is provided by a gas combustion mechanism. The gas combustion mechanism comprises a first priming cylinder (2) having a first piston (4) and an air intake valve (6). The priming cylinder (2) is fluidally connected via a transfer valve (8) to a combustion chamber (10) connected to a second delivery cylinder (12) having a second piston (14). In use, the first piston (4) is arranged to compress air and transfer compressed air to the combustion chamber (10) via the transfer valve (8). The combustion chamber (10) is arranged to receive the compressed air from the priming cylinder (2) and fuel gas from the fuel supply port (16). The air and fuel gas are mixed to form an air/fuel gas mixture therein. The combustion chamber (10) is also arranged so that the air/fuel mixture is ignited therein to impart motion onto the second piston (14) and to facilitate the operation of the tool.

18 Claims, 2 Drawing Sheets

U.S. PATENT DOCUMENTS 4,913,331 A * 4/1990 Utsumi et al. ..... 227/10
5,090,606 A * 2/1992 Torii et al. ..... 227/10
5,181,495 A * 1/1993 Gschwend et al. ..... 123/46 SC
5,191,861 A * 3/1993 Kellerman et al. ..... 123/46 SC
5,842,623 A * 12/1998 Dippold ..... 227/10
5,971,245 A * 10/1999 Robinson ..... 227/10
6,019,075 A * 2/2000 Galka et al. ..... 123/70 R
6,220,496 B1 * 4/2001 Hirai et al. ..... 227/130
6,260,519 B1 * 7/2001 Phillips ..... 123/46 R
6,318,615 B1 * 11/2001 Walter ..... 227/10
6,520,127 B1 * 2/2003 Thieleke et al. ..... 123/46 R
6,786,378 B2 * 9/2004 Wagdy et al. ..... 227/9
6,889,885 B2 * 5/2005 Ohmori ..... 227/10
2004/0134961 A1 7/2004 Wolf et al.
2004/0238588 A1 12/2004 Oda et al.

FOREIGN PATENT DOCUMENTS

GB 1499587 A 2/1978

* cited by examiner

HAND-HELD POWER TOOL

TECHNICAL FIELD

The present invention relates to an internal combustion hand-held power tools, and in particular to an internal combustion fastener-driving tool in the form of a nail gun.

BACKGROUND

Hand-held power tools that use internal combustion as a power source are known. In particular, fastener driving tools are known that drive fasteners, such as nails, into a work piece or substrate. The tools ignite a fuel/air mixture in a combustion chamber to forcibly drive a piston, which then ejects the fastener from the tool. The effectiveness of the prior art tools is largely limited by their efficiency in rapidly igniting the complete volume of fuel/air mixture. If insufficient volumes of fuel ignite, the device delivers unsuitable driving forces to the fastener. If the tool produces unreliable power outputs, the fasteners may be driven to unsatisfactory depths or insufficiently seated. Prior art devices in the past have attempted to address these inefficiencies by making a larger tool and wasting larger volumes of fuel.

Particular examples of such prior art devices are described in International Patent Publication No. WO 2005/063449, the entire disclosure of which is hereby incorporated by cross-reference. In view of the deficiencies of the prior art, the present invention seeks to provide a hand held power tool, in general, and a fastener driving tool, in particular, that will ameliorate or overcome at least one of the deficiencies of the prior art or at least offer a useful alternative.

SUMMARY OF INVENTION

According to one aspect of the invention, there is provided a hand-held power tool, the operational power of which is provided by a gas combustion mechanism, said gas combustion mechanism comprising a first priming cylinder having a first piston and an air intake valve, the priming cylinder being fluidally connected via a transfer valve to a combustion chamber that is connected to a second delivery cylinder including a second piston, wherein in use, said first piston is arranged to compress air and transfer the compressed air to said combustion chamber via said transfer valve, said combustion chamber is arranged to receive said compressed air from the priming cylinder and fuel gas from a fuel supply port, the air and fuel gas being mixed to form an air/fuel gas mixture therein, the combustion chamber and the second delivery cylinder being arranged so that said air/fuel mixture is ignited within the combustion chamber to impart motion onto said second piston and to facilitate the operation of the tool.

Preferably, said first piston is activated for more than one cycle before the compressed air is transferred to said combustion chamber.

Preferably, said each of the compressed air and fuel are introduced in the compressed chamber at a predetermined time sequence that is optimised for particular power/time characteristics of the motion imparted to the second piston.

More preferably, said fuel and compressed air are supplied simultaneously to said combustion chamber.

Preferably, said fuel supply port comprises a fuel injection jet, the jet being arranged for at least one actuation for an operating cycle of the power tool.

More preferably, said fuel injection jet is so shaped as to facilitate increased atomisation of the injected fuel and improve the mixing between air and fuel.

Preferably, said first piston is arranged to compress air to such a degree so as to impart a pressure in the combustion chamber of at least 0.3 bar.

Preferably, said first piston is mechanically or electromagnetically actuated.

Preferably, said fuel supply port comprises a valve that is opened and closed via electro-magnetic or mechanical actuation.

Preferably, said first piston has an internal receiver for storing said pressurised air.

Preferably, a sealing ring having a semi-flexible lip is disposed around the periphery of said second piston.

Preferably, a mixing fan is rotatably mounted to the interior of said combustion chamber.

More preferably, externally mounted motor drives said mixing fan via magnetic coupling.

Preferably, said combustion chamber is exhausted via a plate valve that fluidly connects said combustion chamber with an exhaust plenum when said plate valve is opened.

Preferably, a mechanism movable between a first and a second position includes a latching means for engaging said second position, such that said air/fuel gas mixture is further compressed by said second piston as said mechanism is moved from said first to said second position with said latching means engaged and wherein the force from the ignition of said air/fuel mixture overcomes said latching means and imparts motion to said second piston.

Preferably, a bumper is disposed near the bottom of said second delivery cylinder, said bumper arranged to be compressed by said second piston in the bottom of its travel and wherein the subsequent restoration of said bumper is further arranged to forcibly return said second piston back up said second delivery cylinder.

More preferably, the interior of said bumper forms a chamber arranged to port pressurised air via an outlet valve through a transfer channel to said first priming cylinder as said bumper is compressed.

Preferably, the combustion chamber is spatially separated from said second delivery cylinder.

Preferably, the tool includes more than one air and/or fuel intake valves.

Preferably, the tool comprises a fastener driving means, the means comprising: a tool nose through which a fastener is fired; loading means for introducing said fastener into said tool nose; the arrangement being such that the motion of the second piston propels said fastener away from said tool nose.

More preferably, said fastener-driving means is a nail gun.

MODE OF CARRYING OUT INVENTION

This application is associated with International Patent Publication No. WO 2005/063449, the entire disclosure of which is hereby incorporated by cross-reference.

According to the invention, there is provided a hand-held power-operated tool in the form of a nail gun. At least part of the power necessary to propel the nails is provided by a gas combustion mechanism.

Figure 1:
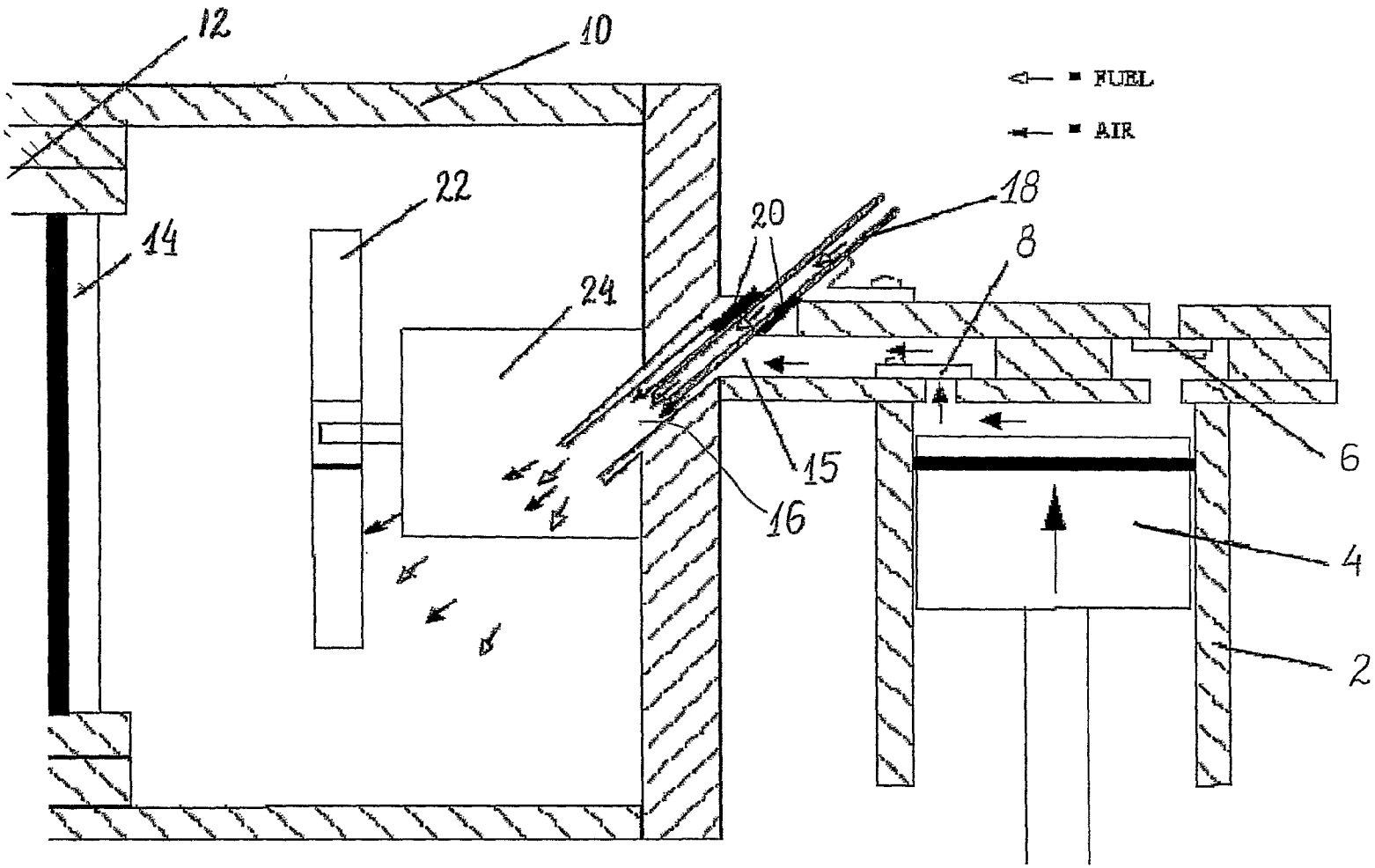
FIG. 1 is a schematic cross-sectional view of a first embodiment of a hand-held power-operated tool of the present invention.
Figure 2:
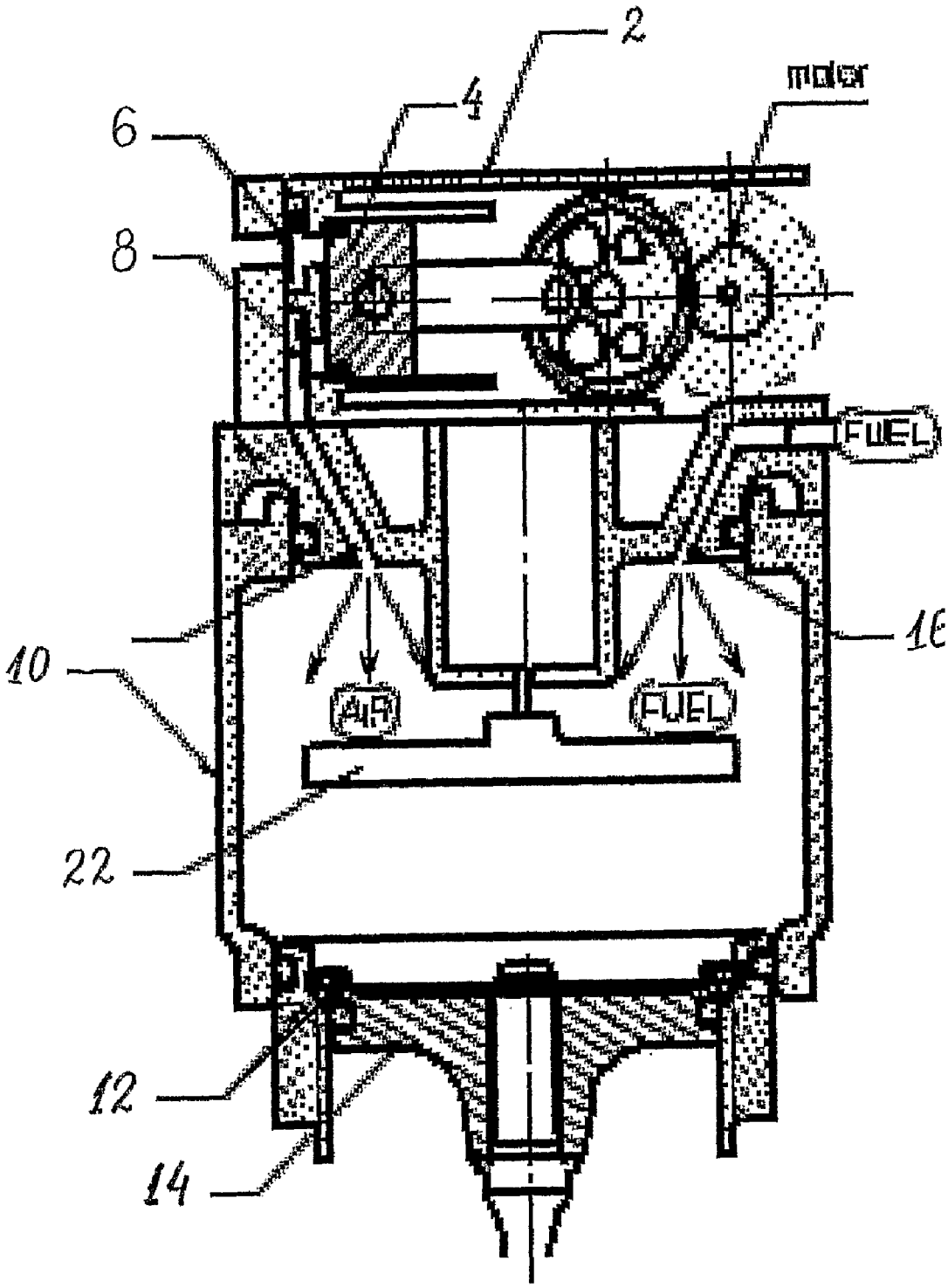
FIG. 2 is a schematic cross-sectional view of a second embodiment of a hand-held power tool of the present invention.

Most of the detailed description of the operation of the tool has already been provided in International Patent Publication No. WO 2005/063449. As also illustrated in FIGS. 1 and 2, the gas combustion mechanism of the present invention comprises a first priming cylinder 2 having a first piston 4 and an air intake valve 6. The priming cylinder 2 is fluidally connected via a transfer valve 8 to a combustion chamber 10 that is connected to a second delivery cylinder 12 having a second piston 14. It should be appreciated that, while in this embodiment the combustion chamber is spatially separated from the delivery cylinder; the chamber can also occupy a portion of the cylinder itself.

The pressurized air from transfer valve 8 enters the combustion chamber 10 via an air injection port 15. The combustion chamber 10 is also supplied with fuel via a fuel supply port 16. The supply port can take many forms and shapes, such as, for example, a fuel supply valve. In the particular embodiment disclosed in FIG. 1, however, the port includes a fuel jet 18. Seals 20 facilitate the assembly of fuel jet 18.

According to the first embodiment of the invention, illustrated in FIG. 1, the fuel jet 16 is arranged to be adjacent to the air injection port 15, so that the fuel and the air enter the chamber in close proximity. However, the second embodiment, shown in FIG. 2, indicates that fuel can be injected in a different location from that of the charged air supply. The fuel and air can also be introduced at different angles, depending on the particular design and performance characteristics required. More than one inlet port for introducing air and/or fuel can also be provided.

Chamber 10 is arranged to receive the compressed air from the transfer valve and facilitate its mixing with the fuel gas obtained from the fuel jet. The mixing can be simply caused by the pressurized air and fuel entering the common enclosure. A fan 22, driven by motor assembly 24, can also be used to facilitate the mixing. In addition, the fuel injection jet 18 can be so shaped so as to facilitate increased atomization of the injected fuel so as to improve the mixing between air and fuel.

In a slightly more detailed description of the operation of the embodiments illustrated in FIGS. 1 and 2, respectively, the first piston 4 is operated by crank and motor (not shown) and reciprocating in cylinder 2. When piston 4 moves in a downward direction, air is drawn through air intake valve 6. When piston 4 moves in an upward direction, the intake valve 6 closes and transfer valve 8 opens, allowing pressurized air to be supplied to air injection port 15. It should be appreciated that, for higher pressures, the first piston 4 may be activated more than one cycle before the pressurised air is transferred into the combustion chamber 10. For a higher energy output, combustion chamber 10 should be charged to a pressure of, for example, 0.3 bar or more.

As charged air passes through the air injection port 15, fuel is injected in to the path of the air stream via fuel injection jet 18. Again, more than one application of fuel can be used at intervals throughout the operation of charging the combustion chamber with air fuel mixture.

While, according to the preferred embodiment, the air and fuel are introduced in to the combustion chamber simultaneously, sequential or phased release during the refreshing charging cycle of the combustion can also be used. Further more, during the combustion phase, or at the point when the burning of the fuel in the combustion chamber is 80-90% completed, additional fuel, or fuel and charged air, may be injected in to the combustion chamber to boost energy output and/or provide a longer energy output pulse.

The described combustion mechanism is appropriately employed within a specific power tool. According to the preferred embodiments of the invention, the combustion chamber 10 is arranged so that said air/fuel mixture is ignited therein to impart motion onto said second piston and propel a fastener, in the form of a nail. A detailed disclosure of operation of the nail gun that embodies the present invention can be found in International Patent Publication No. WO 2005/063449.

Whilst the abovementioned embodiment of the present invention is described with reference to a nail gun, it should be understood that the present invention could be used, but is not limited to, any applications where an object is propelled. Applications not directly related to fastener propelling tools, but associated with this combustion technology can also be envisaged. Such applications can include concrete drilling and the like.

The term "comprising" (and its grammatical variations) as used herein is used in the inclusive sense of "having" or "including" and not in the exclusive sense of "consisting only of".

The invention claimed is:

1. A hand-held power tool, the operational power of which is provided by a gas combustion mechanism, said gas combustion mechanism comprising a first priming cylinder having a first piston and an air intake valve, the priming cylinder being fluidally connected via a transfer valve to a combustion chamber that is connected to a second delivery cylinder including a second piston, wherein in use, said first piston is arranged to compress air and transfer the compressed air to said combustion chamber via said transfer valve, and said first piston is activated for more than one cycle before the compressed air is transferred to said combustion chamber, and said first piston is arranged to compress air to such a degree so as to impart a pressure in the combustion chamber of at least 0.3 bar, said combustion chamber is arranged to receive said compressed air, from the priming cylinder, and fuel gas from a fuel supply port, the air and fuel gas being mixed to form an air/fuel gas mixture therein, the combustion chamber and the second delivery cylinder being arranged so that said air/fuel mixture is ignited within the combustion chamber to impart motion onto said second piston and to facilitate the operation of the tool, wherein a mechanism movable between a first and a second position includes a latching means for engaging said second position, such that said air/fuel gas mixture is further compressed by said second piston as said mechanism is moved from said first to said second position with said latching means engaged and wherein the downward force from the ignition of said air/fuel mixture overcomes said latching means and imparts motion to said second piston.

2. The hand-held power tool as claimed in claim 1, wherein each of the compressed air and fuel are introduced in the combustion chamber at a predetermined time sequence that is optimized for particular power/time characteristics of the motion imparted to the second piston.

3. The hand-held power tool as claimed in claim 2, wherein fuel and compressed air are supplied simultaneously to said combustion chamber.

4. The hand-held power tool as claimed in claim 1, wherein said fuel supply port comprises a fuel injection jet, the jet being arranged for at least one actuation for an operating cycle of the power tool.

5. The hand-held power tool as claimed in claim 4, wherein said fuel injection jet is so shaped as to facilitate increased atomisation of the injected fuel so as to improve the mixing between air and fuel.

6. The hand-held power tool as claimed in claim 1, wherein said first piston is mechanically or electromagnetically actuated.

7. The hand-held power tool as claimed in claim 1, wherein said combustion chamber is spatially separate from said second delivery cylinder.

8. The hand-held power tool as claimed in claim 1, wherein said fuel supply port comprises a valve that is opened and closed via electromagnetic or mechanical actuation.

9. The hand-held power tool as claimed in claim 1, wherein said first piston has an internal receiver for storing pressurised air.

10. The hand-held power tool as claimed in claim 1, wherein a sealing ring having a semi-flexible lip is disposed around the periphery of said second piston.

11. The hand-held power tool as claimed in claim 1, wherein a mixing fan is rotatably mounted to the interior of said combustion chamber.

12. The hand-held power tool as claimed in claim 11, wherein an externally mounted motor drives said mixing fan via magnetic coupling.

13. The hand-held power tool as claimed in claim 1, wherein said combustion chamber is exhausted via a plate valve that fluidly connects said combustion chamber with an exhaust plenum when said plate valve is opened.

14. The hand-held power tool as claimed in claim 1, wherein a bumper is disposed near the bottom of said second delivery cylinder, such bumper arranged to be compressed by said second piston in the bottom of its travel and wherein the subsequent restoration of said bumper is further arranged to forcibly return said second piston back up said second delivery cylinder.

15. The hand-held power tool as claimed in claim 14, wherein the interior of said bumper forms a chamber arranged to port pressurised air via an outlet valve through a transfer channel to said first priming cylinder as said bumper is compressed.

16. The hand-held power tool as claimed in claim 1, the tool including more than one air and/or fuel intake valves.

17. The hand-held power tool as claimed in claim 1, the tool comprising a fastener driving means, the means comprising: a tool nose through which a fastener is fired; loading means for introducing said fastener into said tool nose; the arrangement being such that the motion of the second piston propels said fastener away from said tool nose.

18. The hand-held power tool as claimed in claim 17, wherein said fastener driving means is a nail gun.

* * * * *